US011118333B2

(12) United States Patent
Mitelberg

(10) Patent No.: US 11,118,333 B2
(45) Date of Patent: Sep. 14, 2021

(54) DIMENSIONALLY ADJUSTABLE WASHBASIN SYSTEM

(71) Applicant: Diego Mitelberg, Beer Sheva (IL)

(72) Inventor: Diego Mitelberg, Beer Sheva (IL)

( * ) Notice: Subject to any disclaimer, the term of this patent is extended or adjusted under 35 U.S.C. 154(b) by 7 days.

(21) Appl. No.: 16/629,864

(22) PCT Filed: Jul. 12, 2018

(86) PCT No.: PCT/IL2018/050766
§ 371 (c)(1),
(2) Date: Jan. 9, 2020

(87) PCT Pub. No.: WO2019/012538
PCT Pub. Date: Jan. 17, 2019

(65) Prior Publication Data

US 2021/0148103 A1 May 20, 2021

(30) Foreign Application Priority Data

Jul. 12, 2017 (IL) ..... 253440

(51) Int. Cl.
*E03C 1/14* (2006.01)

(52) U.S. Cl.
CPC ..... *E03C 1/14* (2013.01); *E03C 2201/90* (2013.01)

(58) Field of Classification Search
CPC .... E03C 1/14; E03C 2201/90; E03C 2201/00; E03C 1/32; E03C 1/324; A47K 1/04
USPC ..... 4/653
See application file for complete search history.

(56) References Cited

U.S. PATENT DOCUMENTS 578,582 A * 3/1897 Rapp ..... 4/630
1,102,123 A * 6/1914 Asztalos ..... 4/644
1,602,556 A * 10/1926 Shroyer ..... A47K 1/02 4/630
1,648,386 A * 11/1927 Grover ..... E03C 1/14 4/630
1,909,618 A * 5/1933 Hendrickson ..... A47K 1/02 4/644
2,564,923 A * 8/1951 Patton ..... B61D 35/002 4/630
2,658,232 A * 11/1953 Colonna ..... E05D 7/009 16/382
3,206,770 A * 9/1965 Carlson ..... A47K 1/12 4/638
3,209,371 A * 10/1965 Small ..... E03C 1/01 52/34

(Continued)

FOREIGN PATENT DOCUMENTS

CN 2119873 U 10/1992
CN 1593290 A 3/2005

(Continued)

*Primary Examiner* — Benjamin R Shaw
(74) *Attorney, Agent, or Firm* — Clark Hill PLC; James R. Foley

(57) ABSTRACT

A dimensionally adjustable washbasin system is provided with an upwardly open liquid collecting unit that is at least partially uncovered and in liquid communication with a drainage system; and a washbasin having at least one liquid receiving portion and a liquid discharging portion, such that liquid introduced onto one of the liquid receiving portions is flowable into the liquid collecting unit when the liquid discharging portion is positioned above, and in communication with, the liquid collecting unit.

12 Claims, 8 Drawing Sheets

(56) References Cited

U.S. PATENT DOCUMENTS

| | | | | |
|---|---|---|---|---|
| 4,328,597 | A * | 5/1982 | Bodin | E03C 1/324 4/312 |
| 5,860,437 | A * | 1/1999 | Fernie | E03C 1/057 134/95.2 |
| 2009/0094738 | A1 * | 4/2009 | Epp | A47K 1/04 4/619 |
| 2009/0139023 | A1 | 6/2009 | Talerico | |

FOREIGN PATENT DOCUMENTS

| | | | |
|---|---|---|---|
| CN | 105708180 | A | 6/2016 |
| CN | 106579806 | A | 4/2017 |
| EP | 2101004 | A2 | 9/2009 |
| IT | RM20110541 | A1 | 4/2013 |
| KR | 20000017809 | U | 10/2000 |
| WO | 2014/194890 | A1 | 12/2014 |

* cited by examiner

DIMENSIONALLY ADJUSTABLE WASHBASIN SYSTEM

CROSS REFERENCE TO RELATED APPLICATIONS

This application is a U.S. National Stage entry under 35 U.S.C. § 371 based on International Application No. PCT/IL2018/050766, filed on Jul. 12, 2018, which claims priority to Israel Patent Application No. 253440, filed on Jul. 12, 2017. The embodiment of the priority applications are hereby incorporated herein in their entirety by reference.

FIELD OF THE INVENTION

The present invention relates to the field of sanitary systems. More particularly, the invention relates to a dimensionally adjustable washbasin system.

BACKGROUND OF THE INVENTION

Washbasins are usually permanently installed and fixed to a wall or are generally mounted on a dedicated cabinet, and therefore cannot be removed on demand due to the means of installation to the wall, the mounting of a faucet onto the washbasin, or the presence of a drain pipe downwardly extending from, and connected to, the washbasin.

Unfortunately, a washbasin is generally rather wide, on the order of 50 cm or more, and occupies considerable space in a washbasin area, such as a bathroom. A wide washbasin could restrict passage in a narrow or crowded washbasin area, especially when the washbasin area has to be accessed by a handicapped person with a wheelchair, by a caretaker with a stroller, by a parent with a child, or by an oversized person.

On the other hand, the washing of hands in a relative narrow washbasin on the order of 20 cm, such as mounted on a dedicated cabinet of the same width, is an uncomfortable procedure, which is exacerbated when it has to be accessed by a handicapped person on a wheelchair.

It would be desirable to provide a washbasin system whose width can be speedily and effortlessly adjusted, in order to gain more space when needed.

It is an object of the present invention to provide a washbasin system whose width can be adjusted upon demand from a first width that facilitates a user friendly washing procedure to a second width considerably narrower than the first width that improves access to the washbasin.

It is an additional object of the present invention to provide a washbasin system whose width can be adjusted speedily and effortlessly without using any special tools.

It is an additional object of the present invention to provide a washbasin system that ensures a safe and stable washbasin when positioned at the first width.

Other objects and advantages of the invention will become apparent as the description proceeds.

SUMMARY OF THE INVENTION

A dimensionally adjustable washbasin system comprises an upwardly open liquid collecting unit that is at least partially uncovered and in liquid communication with a drainage system; and a washbasin having at least one liquid receiving portion and a liquid discharging portion, wherein liquid introduced onto one of said liquid receiving portions is flowable into said liquid collecting unit when said liquid discharging portion is positioned above, and in communication with, said liquid collecting unit.

The washbasin system is dimensionally adjustable upon translational or pivotal displacement of the washbasin.

The liquid collecting unit preferably comprises a vertically extending duct which is fixed to an underlying floor, and a drainage pipe in communication with, and having a width considerably less than that of, said duct. The liquid collecting unit may further comprise a cover for covering and being secured to the duct.

In one embodiment, the washbasin system further comprises a base unit for enclosing and concealing the liquid collecting unit, wherein said base unit is configured with an opening to accommodate extension therethrough of the washbasin.

In one embodiment, the washbasin system further comprises one or more support elements for supporting from below the liquid receiving portion of the washbasin. A support element may be a leg which is foldable beneath the washbasin or telescopingly extendable from the underside of the washbasin, in order to contact the underlying floor. Alternatively, the one or more support elements is connected to a wall of a building, for example in a U-shaped configuration, or to a side wall of the base unit when the base unit is employed and the washbasin protrudes outwardly from the front wall of the base unit. The wall-connected support element may be pivoted to a closed position when not in use.

In one aspect, the washbasin is elongated, and the base unit has a front wall which is formed with a slot, the washbasin being introducible through said slot into an interior of the base unit such that the liquid receiving portion is higher than the liquid discharging portion, to ensure gravitation of the flowing liquid from the liquid receiving portion to the liquid discharging portion and then into the liquid collecting unit. The washbasin may be removable from the interior of the base unit.

In one aspect, the washbasin is integrally formed with the liquid collecting unit.

In one aspect, the washbasin has a greater width than depth.

In one aspect, the liquid collecting unit is a fixed sink. The washbasin may be displaceable with respect to the fixed sink.

DETAILED DESCRIPTION OF THE INVENTION

The dimensionally adjustable washbasin system is made possible by the use of an upwardly open liquid collecting unit that is at least partially uncovered and in liquid communication with a drainage system and with a separate washbasin, which generally has a greater width than depth. Liquid introduced into or onto the washbasin, such as from an overlying faucet, is gravitationally discharged to the liquid collecting unit, and then to the drainage system. Since a drainage pipe is not connected to the washbasin, the need to disconnect the drainage pipe is obviated during dimensional adjustment of the washbasin. Accordingly, the washbasin system may be dimensionally adjusted upon demand in order to gain more space in the washbasin area when needed, following translational or pivotal displacement of the washbasin.

In an exemplary implementation, the width of the washbasin system is reduced from a first width to a second width when a handicapped person on a wheelchair approaches the washbasin system. When the handicapped person is sufficiently close to the liquid collecting unit, the washbasin is set to an operative position such that the width of the washbasin system is increased once again to the first width and the washbasin is in liquid communication with the liquid collecting unit. The handicapped person is allowed to comfortably wash his or her hands when the width of the washbasin system is set to the first width.

In some embodiments, the washbasin system also comprises a base unit for enclosing the liquid collecting unit and, optionally, for supporting the displaceable washbasin.

The washbasin may be removed and reinstalled, or even be replaced in order to change the visual appearance of the washbasin system.

Although the description refers mainly to washbasin systems suitable for hand washing and other personal hygiene, it is appreciated that the washbasin system could be used in many other applications such as for providing access to liquid in a kitchen and for industrial purposes.

Figure 6:
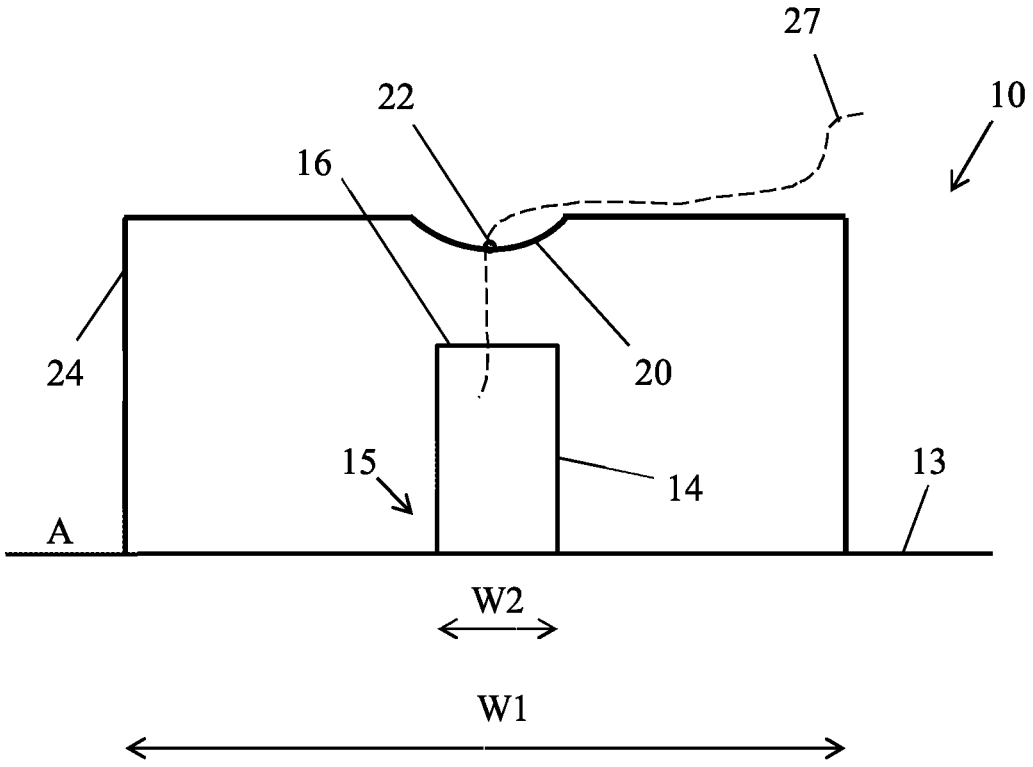
FIG. 6 is a front view of another embodiment of a washbasin system, shown when set to a first width.

To describe some principles of the invention, reference is first made to FIG. 6, which illustrates one embodiment of a washbasin system, generally indicated by numeral 10.

Upwardly open liquid collecting unit 15 is positioned in a central region of a washbasin area A, and has a vertical duct 14 with a wide-area upper edge 16 that defines an area significantly greater than the area defined by the discharge port of a faucet, for example at least 100 $cm^2$, e.g. 225 $cm^2$. Although vertical duct 14 is shown to have a rectangular cross section, it will be appreciated that it may be configured with any suitable horizontal cross section, such as a polygonal cross section or a curved cross section. Duct 14 is fixedly attached to the underlying floor 13 from which it vertically or obliquely extends to upper edge 16, for a height for example of no greater than approximately 70 cm and no less than approximately 30 cm. Duct 14 may be a monolithic member, or alternatively may be comprised of a plurality of interconnected elements, e.g. releasably interconnected, such as elements 501 and 502 shown in FIG. 5, and optionally wherein one or more elements and particularly the uppermost element is sealed to prevent outward seepage of the liquid introduced thererwithin. Upper edge 16 may be covered with cover 29 shown in FIG. 7.

Liquid collecting unit 15 also comprises a drainage pipe (not shown) in communication with duct 14 and with a drainage system, for example an underground drainage system. The drainage pipe, which has a width considerably less than that of duct 14, is located below floor 13, or alternatively its upper edge may be located slightly below floor 13, to receive the liquid flowing downwardly through duct 14.

Washbasin system 10 also comprises a portable washbasin 20, for example made of a relatively lightweight plastic or thermoplastic material, such as poly(methyl methacrylate), e.g. Perspex®. Washbasin 20 is supported by a plurality of vertical legs 24, e.g. four legs, which are held when repositioning washbasin 20. Washbasin 20 has a lower opening 22 through which introduced liquid gravitates into duct 14.

Figure 7:
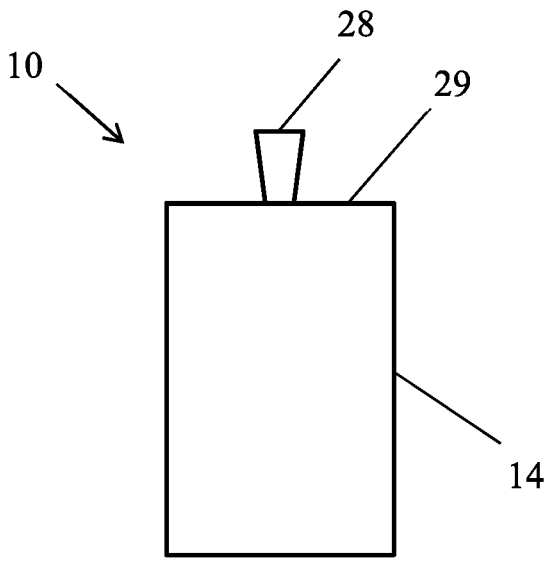
FIG. 7 is a front view of the washbasin system of FIG. 6, when set to a second width.

In use, after the user approaches the washbasin area of liquid collecting unit 15, usually with the assistance of a caretaker, portable washbasin 20 is repositioned to the washbasin area, such that washbasin 20 overlies duct 14. Washbasin system 10 has width W1 following repositioning of washbasin 20, facilitating the pouring of cleansing liquid 27 over the hands of the user to be cleaning onto a liquid receiving portion of washbasin 20 and the gravitation of the soiled cleansing liquid through lower opening 22, duct 14 and then through the drainage pipe. The wide-area duct 14 ensures that the soiled cleansing liquid will gravitate therethrough even though it is not perfectly aligned with opening 22. Upon conclusion of the washing procedure, washbasin 20 is removed and the width of washbasin system 10 is reduced to width W2. The user is then led away from the washbasin area. To prevent any unfortunate accidents, cover 29, which may be pivotally displaceable and connected to duct 14, is placed over and secured to duct 14, as shown in FIG. 7. An ornamental element 28, e.g. a vase, may be placed over the secured cover 29, to improve the appearance of liquid collecting unit 15.

Figure 8:
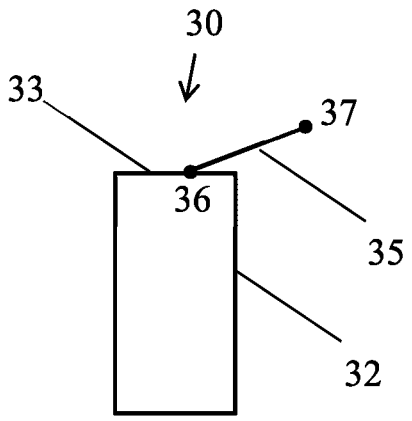
FIG. 8 is a front view of another embodiment of a washbasin system.

In the embodiment of FIG. 8, washbasin system 30 comprises a wide-area duct 32 which is integrally formed with an inclined washbasin 35, such that the upper edge 37 of washbasin 35 is located above upper edge 33 of duct 32. Elongated and inclined washbasin 35 is uncompromised, i.e. formed without any opening, and soiled cleansing liquid gravitates along the length of the washbasin into duct 32. Although the bottom edge 36 of washbasin 35 partially covers upper edge 33 of duct 32, the remaining opening of duct 32 is of sufficient wide area to ensure that all soiled cleansing liquid gravitating along the length of washbasin 35 will be received within duct 32.

In the embodiments of FIGS. 1-5, a washbasin system 101 is provided with a fixed base unit 103, such as a cabinet, adapted to enclose and conceal the liquid collecting unit. Base unit 103 may be openable in order to access the liquid collecting unit or the washbasin.

Figure 1:
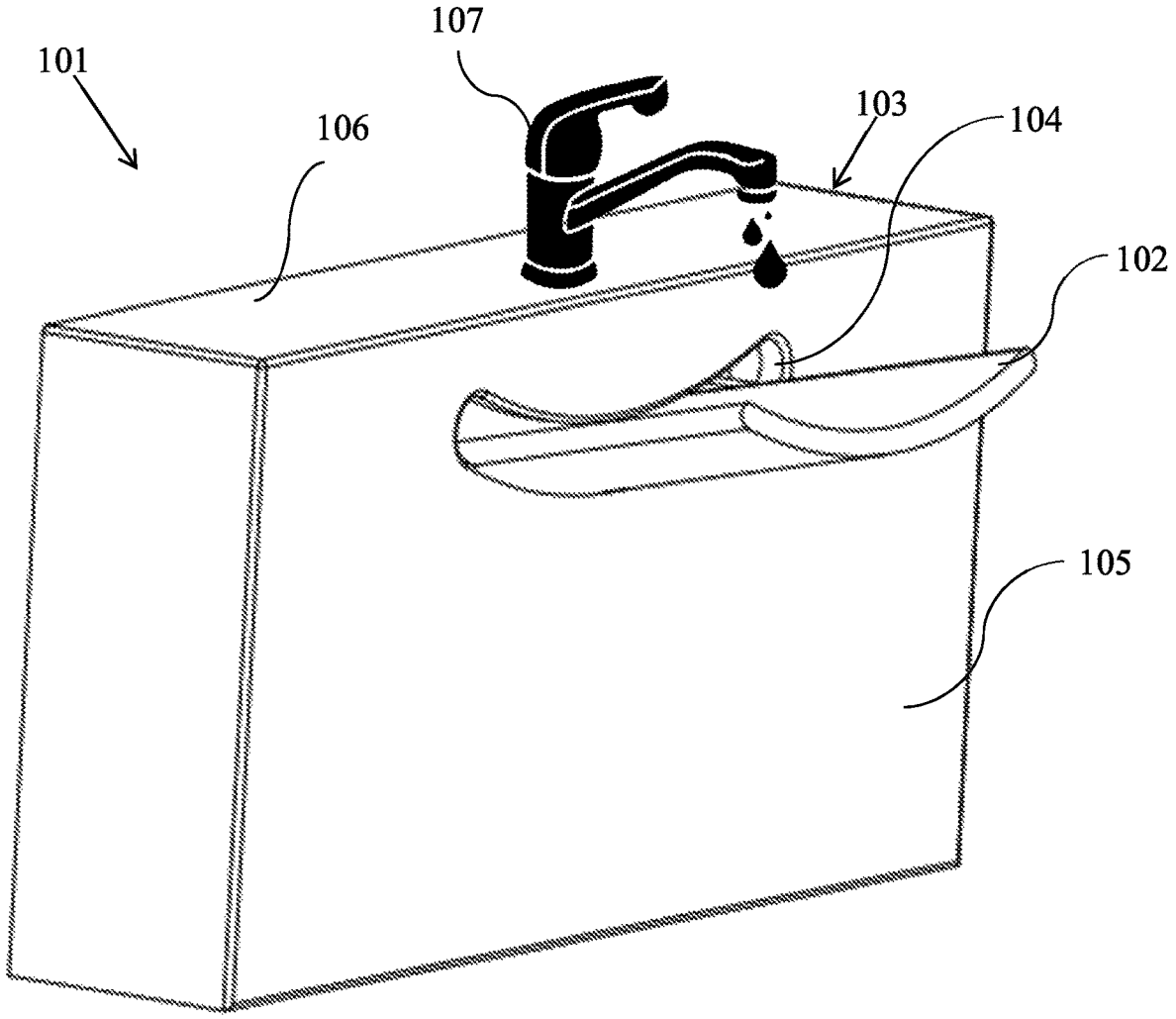
FIG. 1 is a perspective front view of an embodiment of a washbasin system.

FIG. 1 is a perspective front-view of washbasin system 101. In this embodiment, fixed base unit 103 is formed with a slot 104 within its front wall 105. Elongated washbasin 102, which may be made of plastic, ceramic or marble material, is detachable and uncompromised, being slidable along edges of slot 104. System 101 may also comprise a faucet 107 installed on an upper surface 106 of base unit 103. Alternatively, the faucet is wall mounted, so as to be fixed for example to the wall to which base unit 103 is also fixed. Washbasin system 101 is configured in such a way that the water discharged from the faucet is directed to the portion of detachable washbasin 102 that protrudes outwardly from base unit 103. The protruding portion of washbasin 102 is accessible to the hands of a user, and the discharged water will gravitate to the liquid collecting unit.

It will be appreciated that any embodiment described herein may be configured with or without a faucet.

Elongated washbasin 102 may have a plate-like form of uniform cross section with a slightly concave shape, to ensure that the gravitating water flowing in the direction of base unit 103 and the liquid collecting unit will be directed towards a laterally central region of the washbasin, while preventing the gravitating water from overflowing the lateral edges of washbasin 102. The shape of slot 104 may also be slightly concave to permit slidable displacement of washbasin 102.

Washbasin 102 while passing through slot 104 is preferably positioned in an inclined manner relative to base unit 103 such that its protruding portion is higher than the portion thereof from which the water is discharged to the liquid collecting unit, to ensure gravitation of the flowing water. The inclination of washbasin 102 can be facilitated by using an inclined support or rails or by shaping the edges of slot 104 in a corresponding inclined manner.

It may be appreciated that washbasin 102 is not limited to the described shape and can be of any other shape, size, or thickness as long as the gravitating water does not overflow and flows towards base unit 103. For example, the washbasin may be configured as an essentially planar plate having lateral borders that are higher than the center region of the plate or that are rounded.

Figure 2:
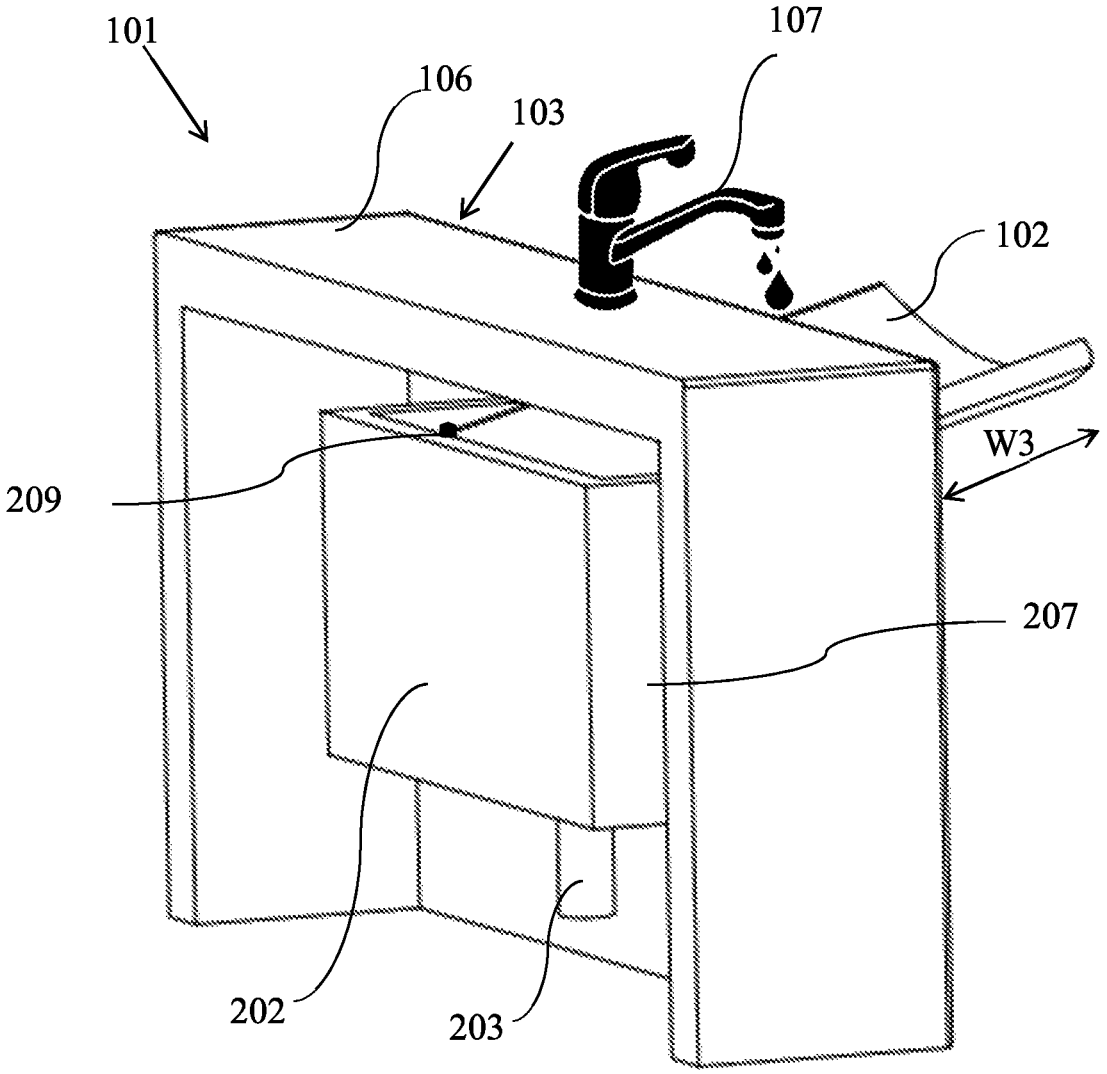
FIG. 2 is a perspective back view of the washbasin system of FIG. 1.

FIG. 2 illustrates liquid collecting unit 202 and a portion of drainage pipe 203 extending therebelow to a drainage system. Liquid collecting unit 202, which is mounted on the rear face 305 (FIG. 3A) of the front wall of base unit 103, is shown to be rectilinear and to be spaced from the underlying floor. Any other configuration of the upwardly open liquid collecting unit is also within the scope of the invention. Each side 207 of liquid collecting unit 202 is provided with a support element 209 for supporting the lower discharge portion of washbasin 102, while ensuring that the lower discharge portion of the washbasin is spaced from the rear wall of the liquid collecting unit and that water will be discharged into the interior of liquid collecting unit 202.

Figure 3A:
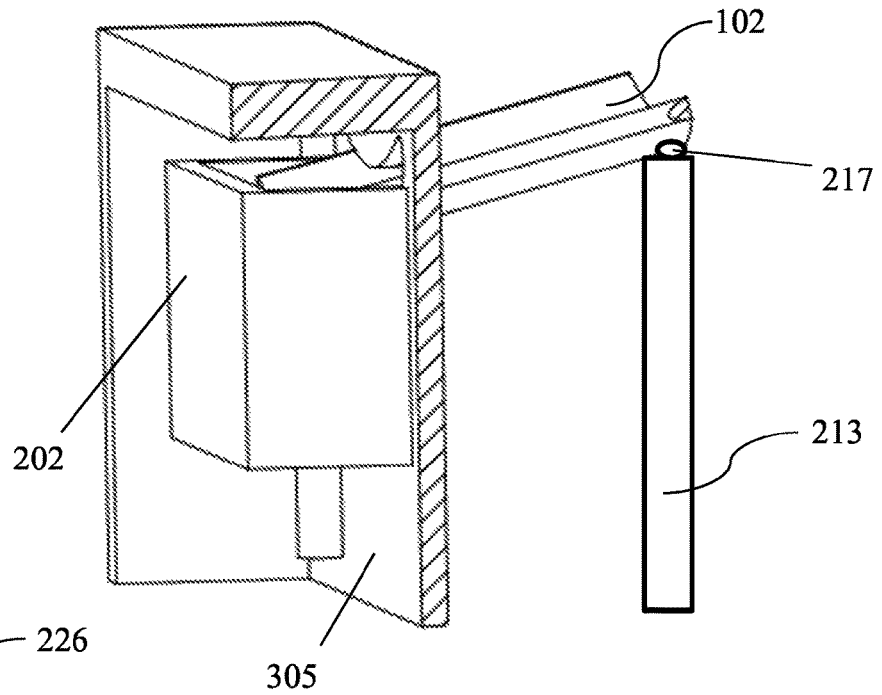
FIG. 3A is a perspective cross sectional view from the side of the washbasin system of FIG. 1, cut along a vertical plane and showing a support element for a washbasin.
Figure 4:
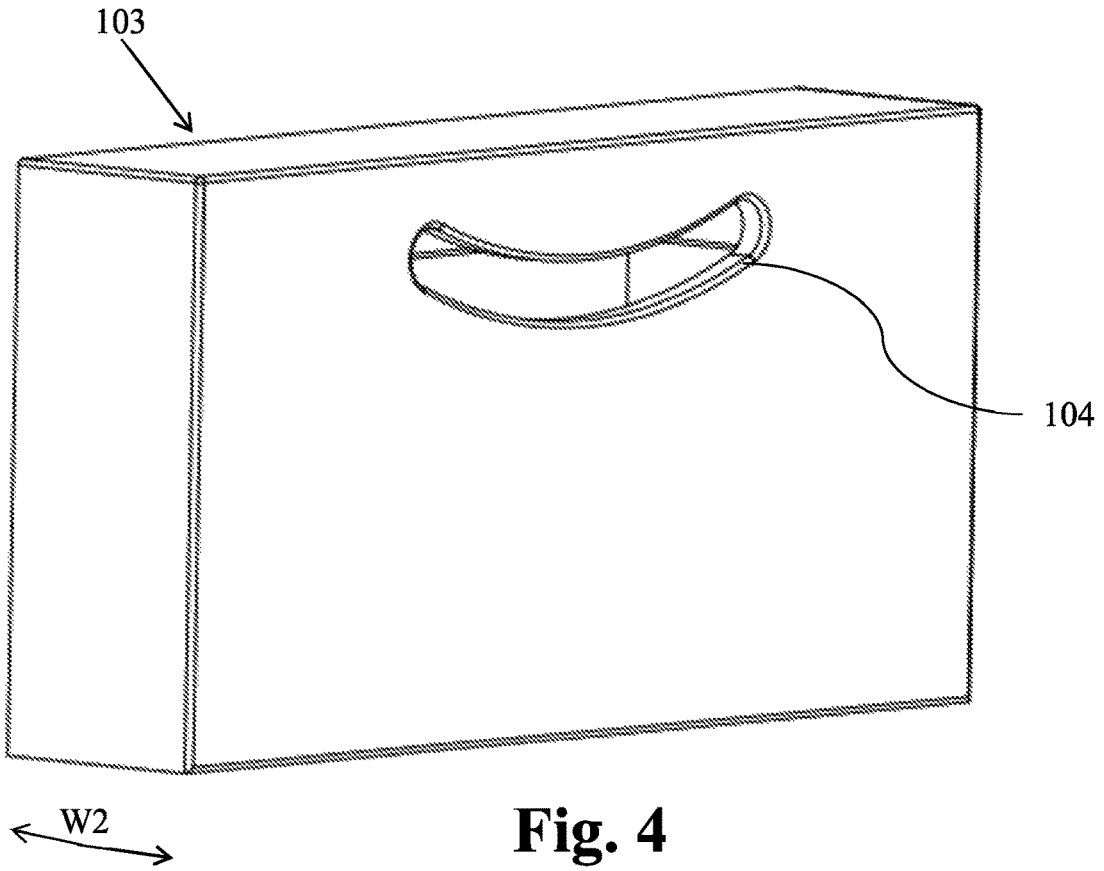
FIG. 4 is a perspective front view of the washbasin system of FIG. 1, shown when the washbasin has been removed.

When washbasin 102 whose protruding portion having a width W3 is removed from base unit 103 via the slot, the width of the washbasin system is reduced by W3, to provide the second width W2 as defined by the dimensions of basin unit 103 as shown in FIG. 4, in order to accommodate users who need added space in a washbasin area, The protruding portion of washbasin 102 may be supported from below by a foldable leg 213 in contact with the underlying floor, as shown in FIG. 3A. When washbasin 102 is removed from base unit 103, leg 213 is folded along the underside of washbasin 102 by pivotal connection 217. Other releasable support means well known to those skilled in the art, such as one or more blocks, may be provided at the underside of washbasin 102.

Such support means may be employed in conjunction with other embodiments described herein.

Figure 3C:
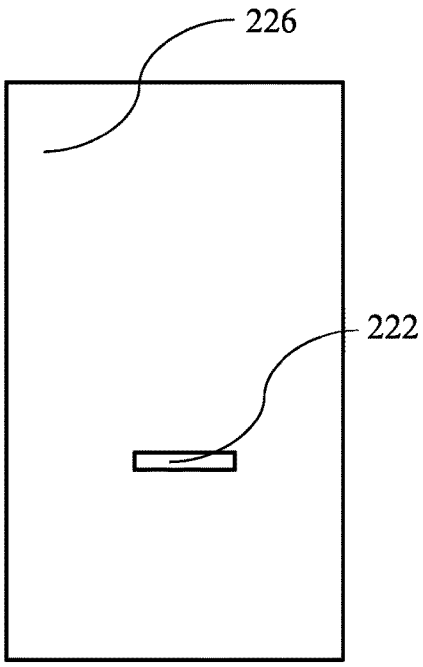
FIG. 3C is a front view of a wall formed with a notch, for use in conjunction with the washbasin system of FIG. 1.
Figure 3B:
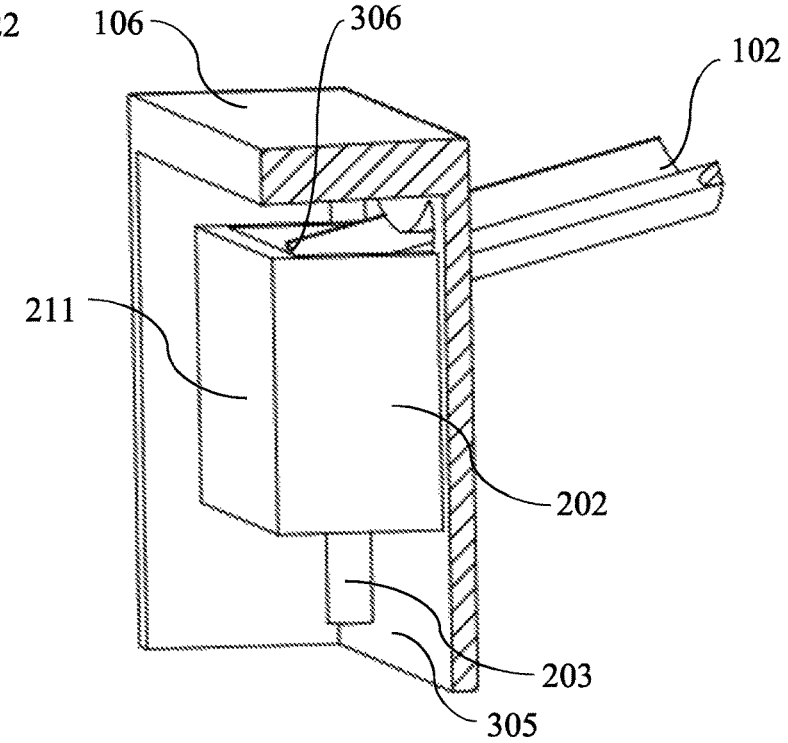
FIG. 3B is a perspective cross sectional view from the side of the washbasin system of FIG. 1, cut along a vertical plane and showing a washbasin when in forcible contact with the rear wall of a liquid collecting unit.
Figure 5:
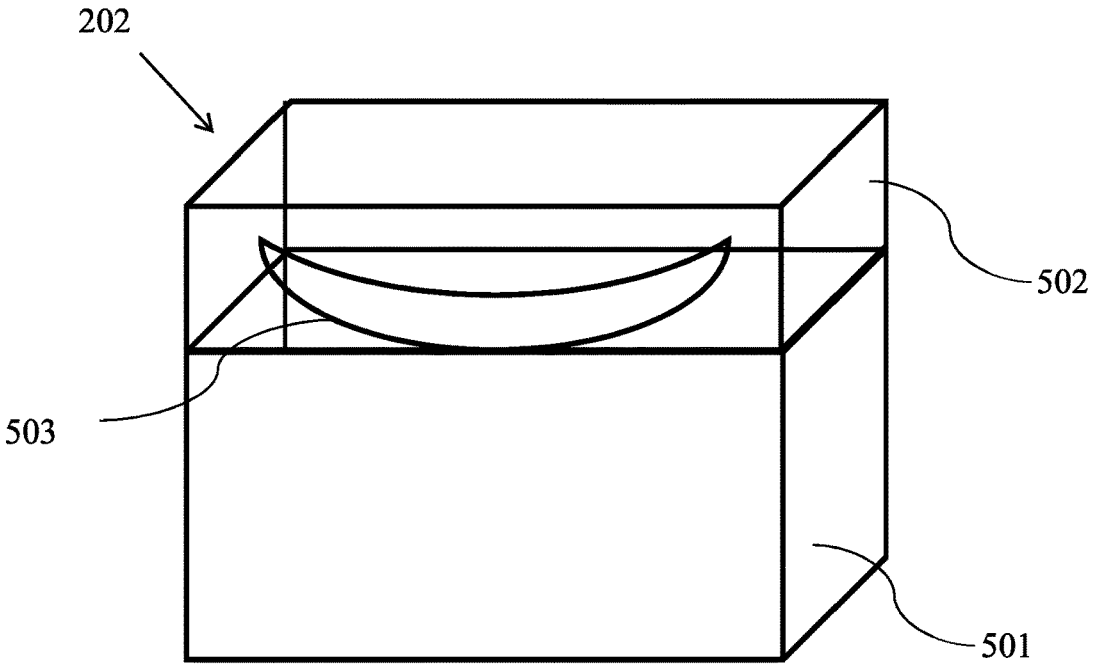
FIG. 5 is a perspective front view of an embodiment of a liquid collecting unit.

Alternatively, the lower discharge portion of a washbasin is formed with a discharge opening for the discharge therefrom of the gravitating water, and is engaged with, and supported by a slot 503 formed in the rear wall of the liquid collecting unit 202 as shown in FIG. 5, or is in forcible contact with the rear wall 211 of liquid collecting unit 202 as shown in FIG. 3B such that the rearwardmost portion 306 of washbasin 102 is applied with rubber or silicon, or other low friction material.

Alternatively, the lower discharge portion of an inclined and detachable washbasin formed with a discharge opening overlies the liquid collecting unit, and is engaged with, and supported by a notch 222 formed in the wall 226 to which base unit 103 is fixed, as shown in FIG. 3C. If so desired, the width of the washbasin system may be reduced by translationally displacing the inclined washbasin inwardly via the notch and the slot formed in the base unit, and the washbasin will be supported by one or more support elements provided within the base unit, such as blocks which may have a top coating of rubber or silicon, or other low friction material.

Figure 9:
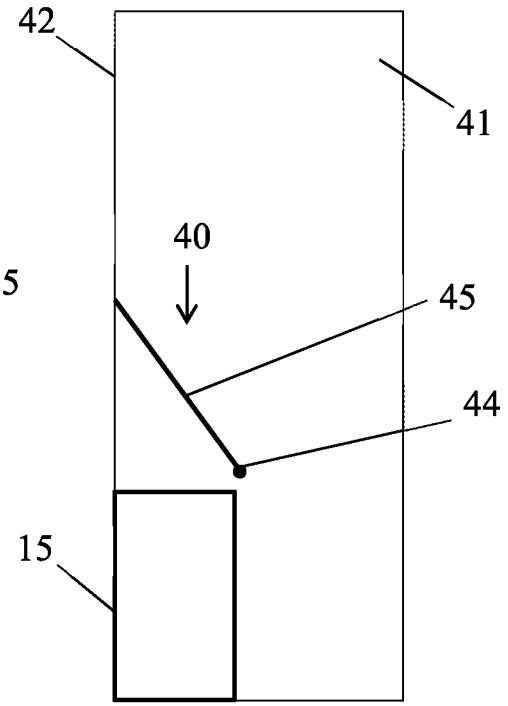
FIG. 9 is a side view of another embodiment of a washbasin system, shown when set to the second width.
Figure 10:
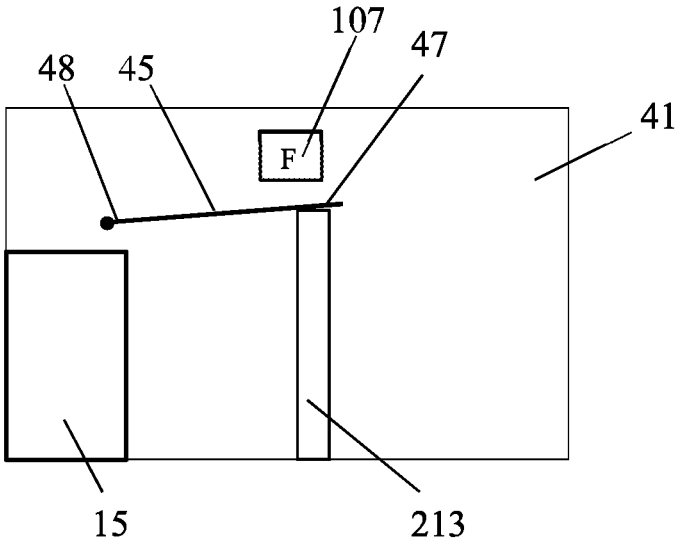
FIG. 10 is a side view of the washbasin system of FIG. 9, shown when set to the first width.

In the embodiments of FIGS. 9-10, washbasin system 40 is dimensionally adjusted by pivotally displacing washbasin 45. When not in use, elongated washbasin 45 is pivoted in one rotational direction by pivotal connection 44 mounted on wall 41 so as to be in contact with a portion of wall 42 above liquid collecting unit 15, to increase the available space in the vicinity of the washbasin area. Prior to a washing procedure, washbasin 45 is pivoted in the opposite rotational direction, and then supporting leg 213 is unfolded to contact the underlying floor. Accordingly, liquid receiving portion 47 of washbasin 45 is located underneath faucet 107 mounted on wall 41 and discharge portion 48 of washbasin 45, which is located at a height below liquid receiving portion 47, is located above the upper edge of the duct of liquid collecting unit 15. Thus water will gravitate along washbasin 45 during a washing procedure and into liquid collecting unit 15.

Figure 11:
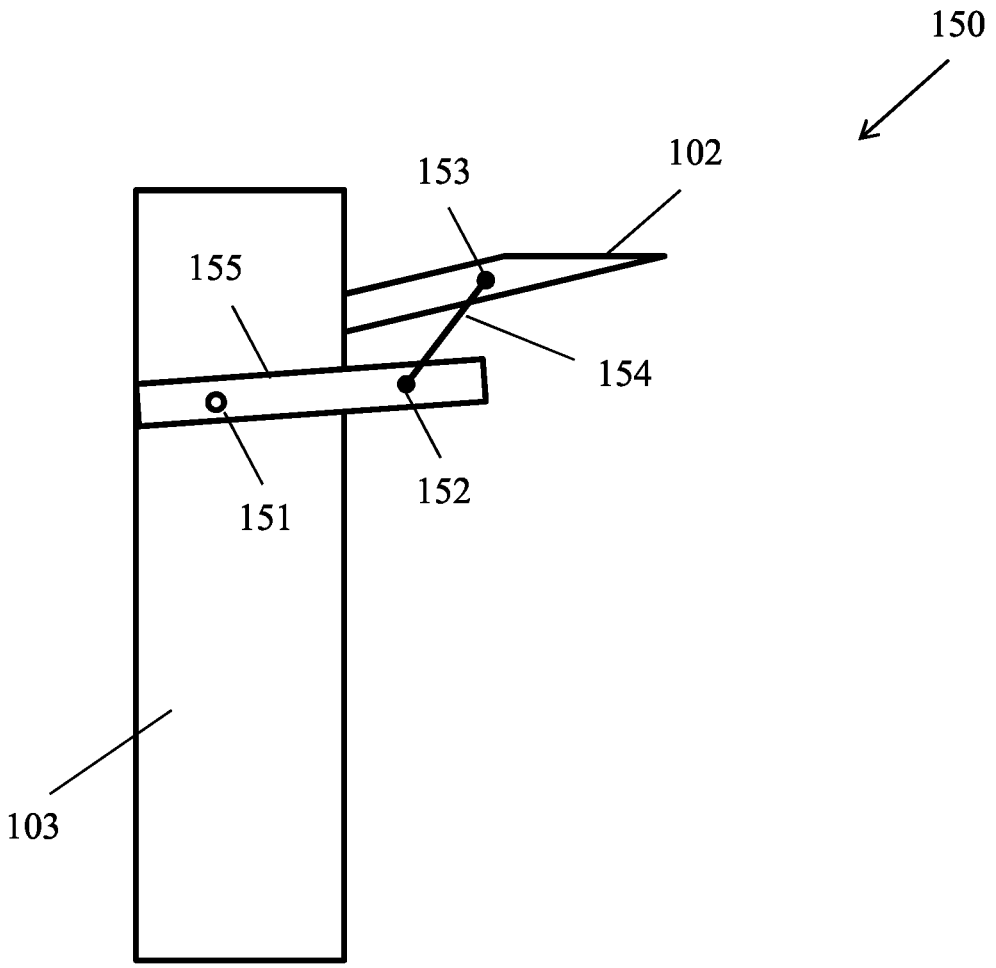
FIG. 11 is a side view of another embodiment of a washbasin system, showing a linkage provide therewith and a portion of the base unit.

In the embodiment of FIG. 11, washbasin system 150 comprises a linkage for both pivotally displacing elongated washbasin 102 and for longitudinally displacing the washbasin through the slot formed in the front wall of base unit 103. The linkage, when properly manipulated, may effect either pivotal displacement or longitudinal displacement.

A support element 155 is pivotally connected to a side wall of base unit 103 by joint 151. Link 154 is pivotally connected by joint 153 to the liquid receiving portion of washbasin 102 and by joint 152 to a portion near the terminal end of support element 155.

Figure 12:
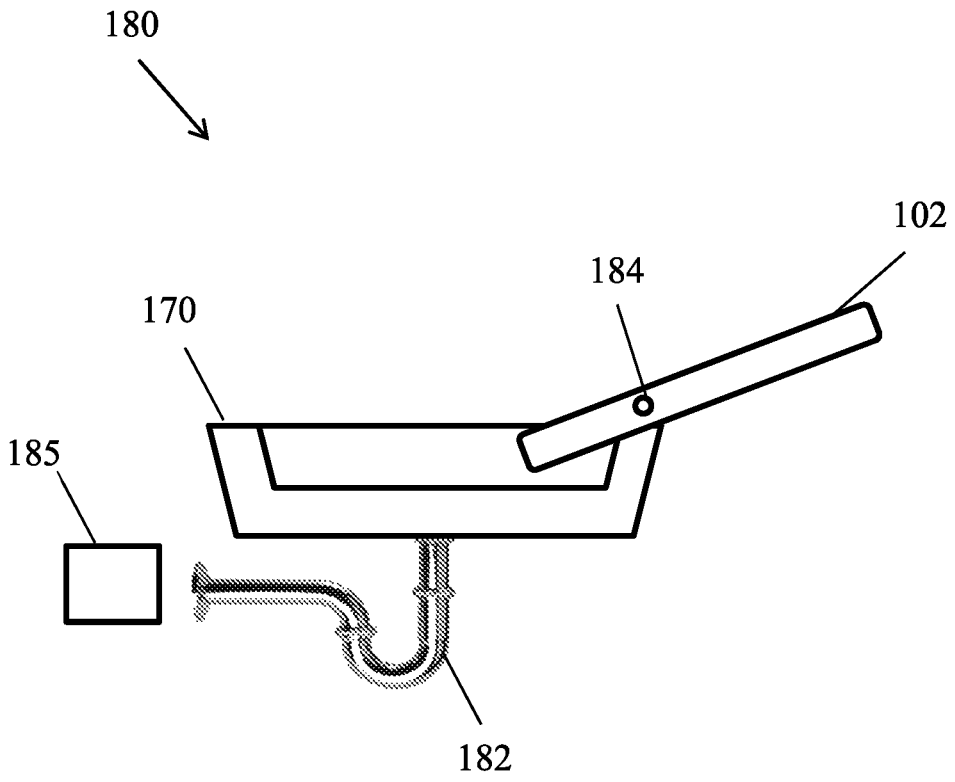
FIG. 12 is a schematic front view of another embodiment of a washbasin system.

In the embodiment of FIG. 12, washbasin system 180 comprises a fixed sink 170 having a siphon or water trap 182 connected to drainage system 185 constitutes the liquid collecting unit. Elongated washbasin 102 is pivotally connected to a wall of sink 170 by joint 184 in order to adjust the width of the washbasin system. Alternatively, washbasin 102 is unconnected to sink 170, and serves as an extension to sink 170 when slidable or selectively positioned thereon. Washbasin 102 may be supported by a supporting element according to any embodiment described herein.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A dimensionally adjustable washbasin system, comprising:

a) an upwardly open liquid collecting unit that is at least partially uncovered and in liquid communication with a drainage system;

b) a washbasin having at least one liquid receiving portion and a liquid discharging portion, wherein liquid introduced onto one of said liquid receiving portions is flowable into said liquid collecting unit when said liquid discharging portion is positioned above, and in communication with, said liquid collecting unit c) a base unit for enclosing and concealing the liquid collecting unit, wherein said base unit is configured with an opening to accommodate extension therethrough of the washbasin; and d) a linkage for both pivotally displacing the washbasin and for longitudinally displacing the washbasin through a slot formed in a front wall of said base unit.

2. The washbasin system according to claim 1, wherein the liquid collecting unit comprises a vertically extending duct which is fixed to an underlying floor, and a drainage pipe in communication with, and having a width considerably less than that of, said duct.

3. The washbasin system according to claim 2, wherein the liquid collecting unit further comprises a cover for covering and being secured to the duct.

4. The washbasin system according to claim 1, wherein the washbasin is elongated.

5. The washbasin system according to claim 1, wherein the base unit has a front wall which is formed with a slot, the washbasin being introducible through said slot into an interior of the base unit such that the liquid receiving portion is higher than the liquid discharging portion, to ensure gravitation of the flowing liquid from the liquid receiving portion to the liquid discharging portion and then into the liquid collecting unit.

6. The washbasin system according to claim 5, wherein the washbasin is removable from the interior of the base unit.

7. The washbasin system according to claim 5, further comprising one or more support elements for supporting from below the liquid receiving portion of the basin which protrudes outwardly from the front wall of the base unit.

8. The washbasin system according to claim 1, which is dimensionally adjustable upon translational or pivotal displacement of the washbasin.

9. The washbasin system according to claim 1, wherein the washbasin has a greater width than depth.

10. The washbasin system according to claim 1, wherein the washbasin is integrally formed with the liquid collecting unit.

11. The washbasin system according to claim 1, wherein the liquid collecting unit is a fixed sink.

12. The washbasin system according to claim 1, wherein a fixed sink having a siphon or water trap connected to drainage system constitutes the liquid collecting unit and the washbasin is pivotally connected to a wall of said fixed sink by joint in order to adjust the width of the washbasin system.

* * * * *